US005088394A

United States Patent [19]

Bertrand et al.

[11] Patent Number: 5,088,394

[45] Date of Patent: Feb. 18, 1992

[54] BINDING DEVICE WITH IMPROVED TWISTING HEAD AND BINDER EQUIPPED WITH SUCH DEVICES, IN PARTICULAR FOR BINDING COILS OF WIRE

[75] Inventors: Jean M. Bertrand, Cormeilles; Jean V. Joannic, Paris, both of France

[73] Assignee: Botalam (S.A.R.L.), France

[21] Appl. No.: 569,821

[22] Filed: Aug. 20, 1990

[30] Foreign Application Priority Data

Aug. 21, 1989 [FR] France ..... 89 11062

[51] Int. Cl.[5] ..... B65B 13/28

[52] U.S. Cl. ..... 100/12; 100/31; 140/93.6

[58] Field of Search ..... 100/12, 31, 29, 32, 100/8; 140/93 A, 93.6; 53/370

[56] References Cited

U.S. PATENT DOCUMENTS 2,674,181 4/1954 Jones ..... 100/31
3,842,728 10/1974 Elineau ..... 100/12
4,459,904 7/1984 Probst et al. ..... 100/31

FOREIGN PATENT DOCUMENTS 2802909 8/1978 Fed. Rep. of Germany ..... 100/31

*Primary Examiner*—Philip R. Coe
*Assistant Examiner*—Reginald L. Alexander
*Attorney, Agent, or Firm*—Anthony J. Casella; Gerald E. Hespos

[57] ABSTRACT

A binding device is provided for placing a flexible bond (F) around an article to be bound. The binding device includes guide members (10, 11) for bringing two opposed end lengths of the flexible bond to cross over each other, and a head (32) placed at the rear of the guide members for twisting the end lengths. The head includes a gripper (**32*a*) mounted on the end of a rotary body (33). A threaded portion (41) of the body (33) of the twisting head (32) is threadedly engaged in a nut (42) integral with the frame. A coupling member (44) surrounds a portion of the body (33) such that the body (33) is slidingly mounted in the coupling member (44**). Rotation of the coupling member achieves the rotational driving of the body of the twisting head and simultaneously permits a continuous axially advancement of the body of the twisting head due to the threaded engagement of the body with the nut.

6 Claims, 4 Drawing Sheets

BINDING DEVICE WITH IMPROVED TWISTING HEAD AND BINDER EQUIPPED WITH SUCH DEVICES, IN PARTICULAR FOR BINDING COILS OF WIRE

The present invention relates to a binding device comprising, on a frame associated with a supporting structure for an item to be bound, means for placing a flexible bond around the latter comprising guide members for bringing its two end lengths to cross each other, and a head for twisting them placed at the rear of the said guide members and composed of a gripper mounted on the end of a rotary body.

Such binding devices are to be found on wire coil compacting and binding apparatus, in which they are distributed in a circle on a common support, rearwards of the compacting unit.

As we know, one drawback of current wire coil compacting and binding apparatus is that, in each binding device, the twisting head, for constructional reasons, can only act in rotation on the flexible bond, and then at a great distance, in the order of 60 mm, from the coil of wire to be bound. While this may have no effect upon binding quality in the case of wire coils of high elasticity which compensates for this twist play after compacting, this is by no means the case when the wire is produced by rolling with an increased diameter which reduces by as much the elasticity of the coil formed. The result is that the bonds, which are not tight enough around the coil of wire, often slide along it, for example during handling or transport, and that the coil may thus come undone.

The aim of the present invention is to remedy this drawback and, in order to do so, it provides a binding device of the type specified in the preamble which is characterized in that it comprises means for guiding and driving the twisting head in translation designed to act on the body of the latter during its rotation, the said members for guiding the flexible bond being withdrawable in synchronism the translation of the twisting head.

The twisting head can thus, during its rotation, advance in the direction of the wire coil to be bound, until it reaches a distance which, while it certainly still presents limitations in practice, is nonetheless sufficiently reduced, being approximately halved, to ensure good quality, firm binding in combination with the elasticity of the coil of wire, even if the wire is obtained by rolling.

According to one form of embodiment, which it would seem appropriate to take as a preferred one, by reason of its simplicity of design and reliable operation, the said means for guiding and driving in translation comprise a nut integral with the frame, in which is screwed a threaded portion of the body of the twisting head, which is further slidingly mounted in a member for coupling to a means that rotates it.

Advantageously, the said coupling member is a toothed pinion retained around the body of the twisting head by an axially splined connection and engaging with a toothed driving wheel constituting the said rotating means.

Moreover, and according to another feature of the invention, the gripper is composed of two jaws articulated on the body of the twisting head, each being extended, beyond their axis of articulation, by a rear heel, and it is further associated with a jack formed in the body with its rod pointing towards the heels of the jaws and ending in a head of a generally conical shape designed to engage between the latter, the heels of the jaws of the gripper being further urged towards one another in rest condition. There are thus provided simple means for actuating the gripper which do not, moreover, increase the overall dimensions of the binding device.

For their part, the said members for guiding the flexible bond are preferably constituted by pivoting thread guide beaks crossing one another at an active position in the translation path of the twisting head and cyclically movable from the said path by swinging means.

The present invention also relates to an apparatus for binding articles of an annular shape, in particular to a wire coil compacting and binding apparatus, of the type comprising several binding subassemblies arranged in a circle on a common support, and which is characterized in that the binding subassemblies are constituted by binding devices as defined earlier.

In a preferred form of embodiment that considerably simplifies the control of the twisting heads of the different binding devices, the heads are orientated in the same direction with their axes substantially parallel to the central axis of the article to be bound and their coupling pinions engage with a common toothed driving wheel.

The present invention will now be described in greater detail, but without this being in any way limitative, with reference to the annexed drawings, wherein:

FIG. 1 diagrammatically represents, in side view, a compacting and binding apparatus according to the invention;

Figure 4:
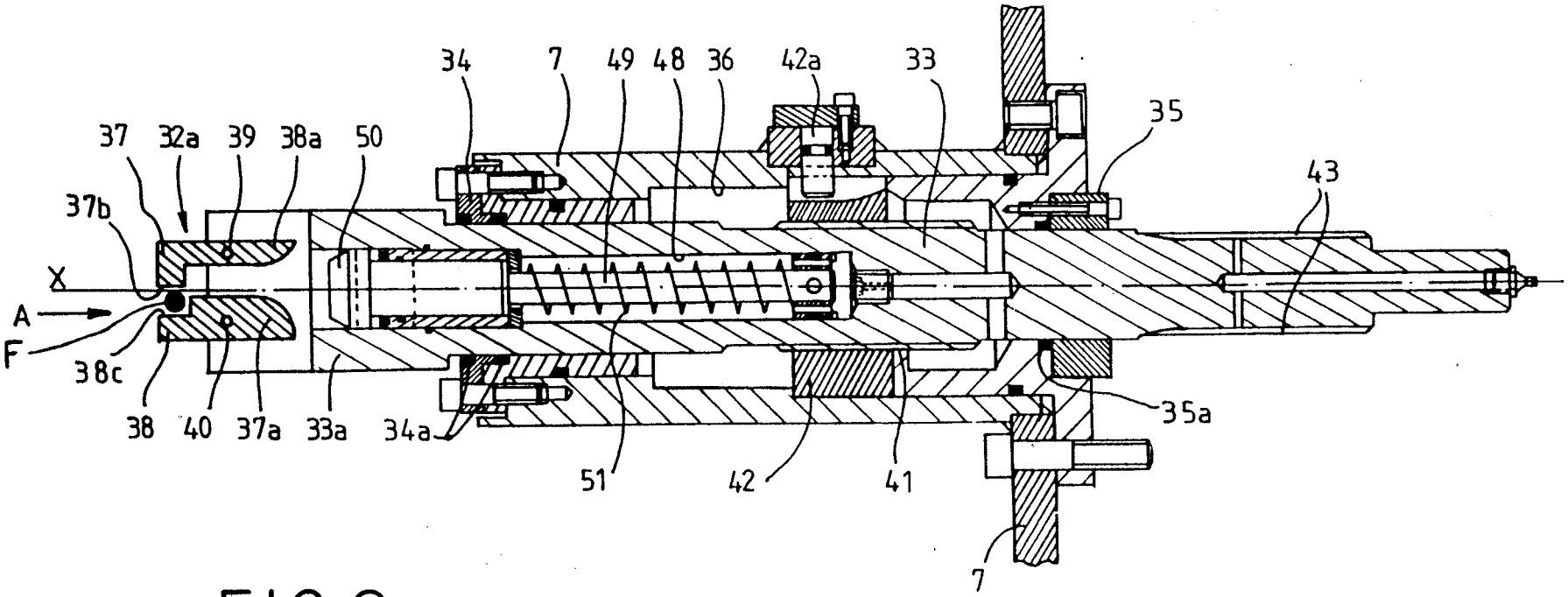
FIG. 4 is a longitudinal cross-sectional view along line IV—IV of FIG. 3, of the twisting head of this binding device.
Figure 8:
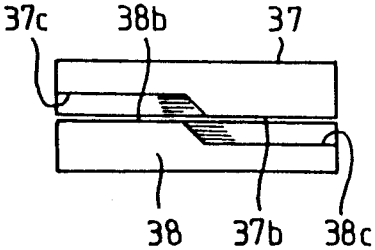
Figure 5:
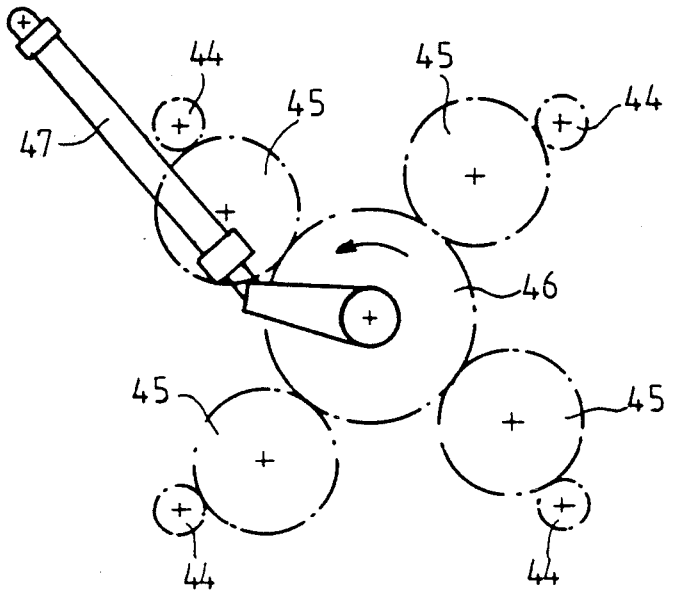
Figure 6:
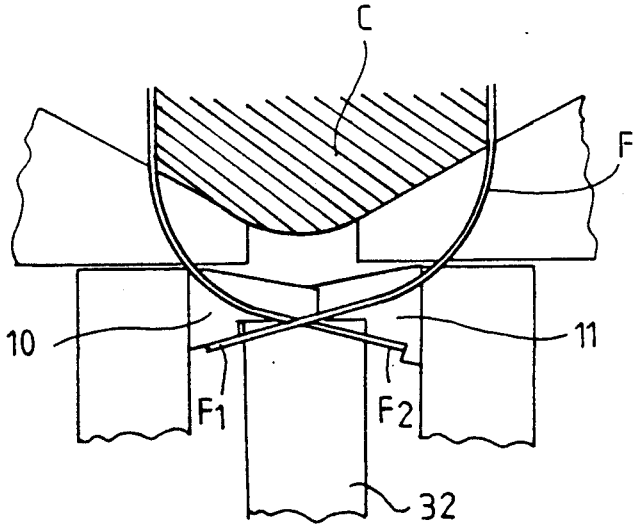
Figure 7:
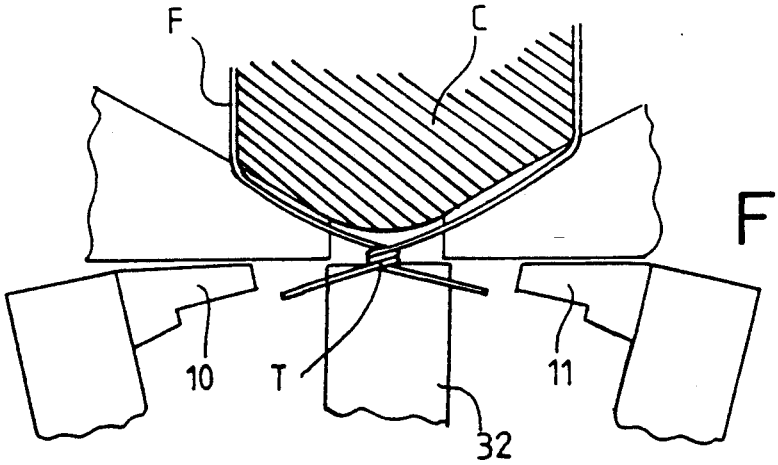

FIG. 5 diagrammatically represents, in rear view, the system for controlling the different twisting heads of the binding devices of the compacting and binding apparatus;

FIGS. 6 and 7 are diagrams illustrating two phases in the operation of the binding device; and FIG. 8 is an enlarged front view of the twisting head, in the direction of arrow A of FIG. 4.

Figure 1:
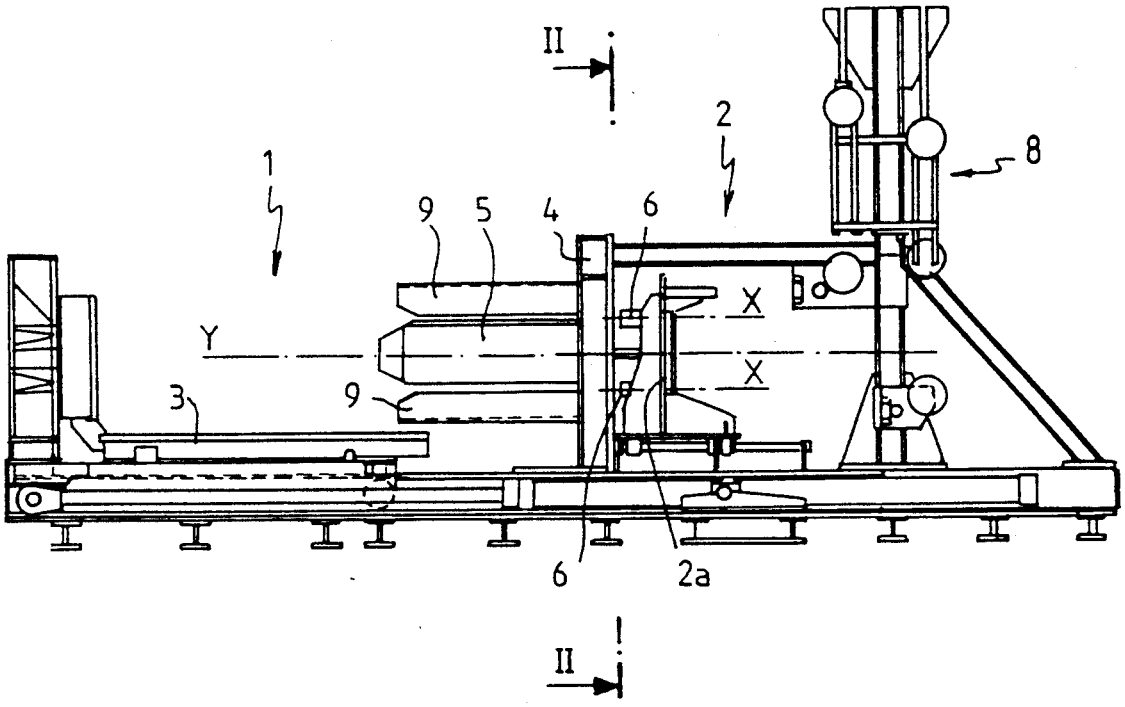

The compacting and binding apparatus of which an example is shown in FIG. 1 is composed of a compacting unit properly speaking, 1, followed by a binding unit 2. In a manner known per se, compacting unit 1 comprises a carriage 3 which, after receiving a cylindrical coil of wire for binding, formed at an upstream binding station, moves it and compresses it against an anvil 4, passing it round an axial mandrel 5 projecting in front of the anvil.

Figure 2:
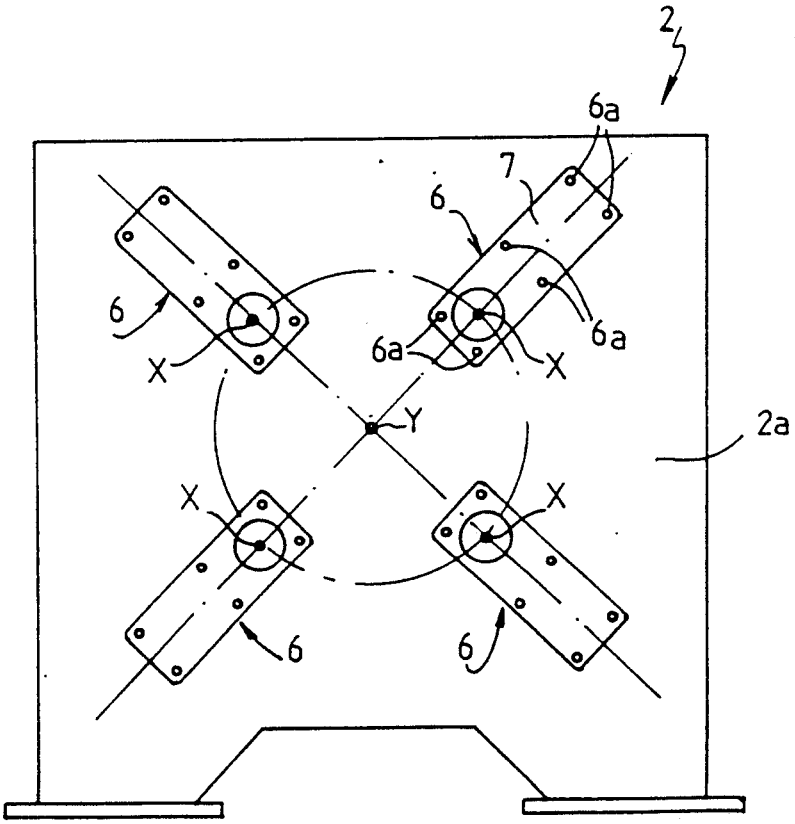
FIG. 2 is a diagrammatic enlarged cross section along line II—II of FIG. 1.

Rearwards of anvil 4, binding unit 2 has four identical binding devices 6 which, as shown in FIG. 2, are bolted at 6a, by their respective frames 7, to a face, turned towards anvil 4, of a common support 2a upon which they are arranged in a circle, being placed at an angle of 90° from one another. Binding devices 6 are associated with respective binding thread supply reels identified by the general reference number 8. They further have a main work axis X parallel with axis Y of mandrel 5 and positioned in the prolongation of the wire coil reception space, defined between the latter and a corresponding lateral arm 9, also formed so as to project in front of anvil 4.

The structure of one of binding devices 6, which is identical in all respects with that of the other three, will now be described with reference to FIGS. 3 and 4.

The first of these figures shows, in the first place, on the front face of the binding device, two thread guide beaks, 10,11, slightly offset in a direction perpendicular to the plan of the drawing. These thread guide beaks are provided with corresponding channels 10*a*,11*a* converging with one another towards anvil 4 until they cross. In addition, each thread guide beak 10 or 11 is extended at the rear by a corresponding support arm 12 or 13 articulated at 14 or 15 on frame 7 about axes that are parallel with one another and perpendicular to the main axis X of the device. On each of these arms, 12,13, there is further articulated, at 16 and 17, a link 18,19, a long one for thread guide 10 and a short one for thread guide 11. The two links, 18,19, pointing towards central axis Y of binding unit 2, are articulated at 20 and 21 on a rocking lever 22, which is itself supported at its centre by a pin 23 pivoting in frame 7. At the rear of this pin 23, lever 22 has a protuberance 24 the end of which articulates on a pin 25 blocked between two circular flanges 26,27 formed at the end of rod 28 of a jack 29 borne by support 2*a*. This jack 29, which is centered on the Y axis of the binding unit 2, is common to the four binding devices 6 and, consequently, when it is extended, it places and maintains the wire guide beaks 10,11 of each of them in their active position as in FIG. 3, via the respective mechanisms constituted by rocking lever 22 and links 18,19.

Just behind the two thread guide beaks 10,11 is located a twisting head 32, which will be described with reference to FIGS. 3,4 and 8.

The rear portion of this twisting head 32 consists of a body of revolution 33, retained by bearings 34,35 having seals 34*a*,35*a* inside a bore 36 of frame 7, provided betwen the articulating arms of beaks 10,11. Beyond front bearing 34, an extension 33*a* of body 33 bears a gripper 32*a* formed by two jaws 37,38 articulated about parallel axes 39,40 perpendicular to the axes of articulation 14,15 of arms 12,13 of the thread guide beaks. In their rest position represented in FIG. 4, these jaws, 37,38, are held slightly apart by return springs, not shown, acting between heels 37*a*,38*a*, prolonging them beyond their axes of articulation 39,40.

Figure 3:
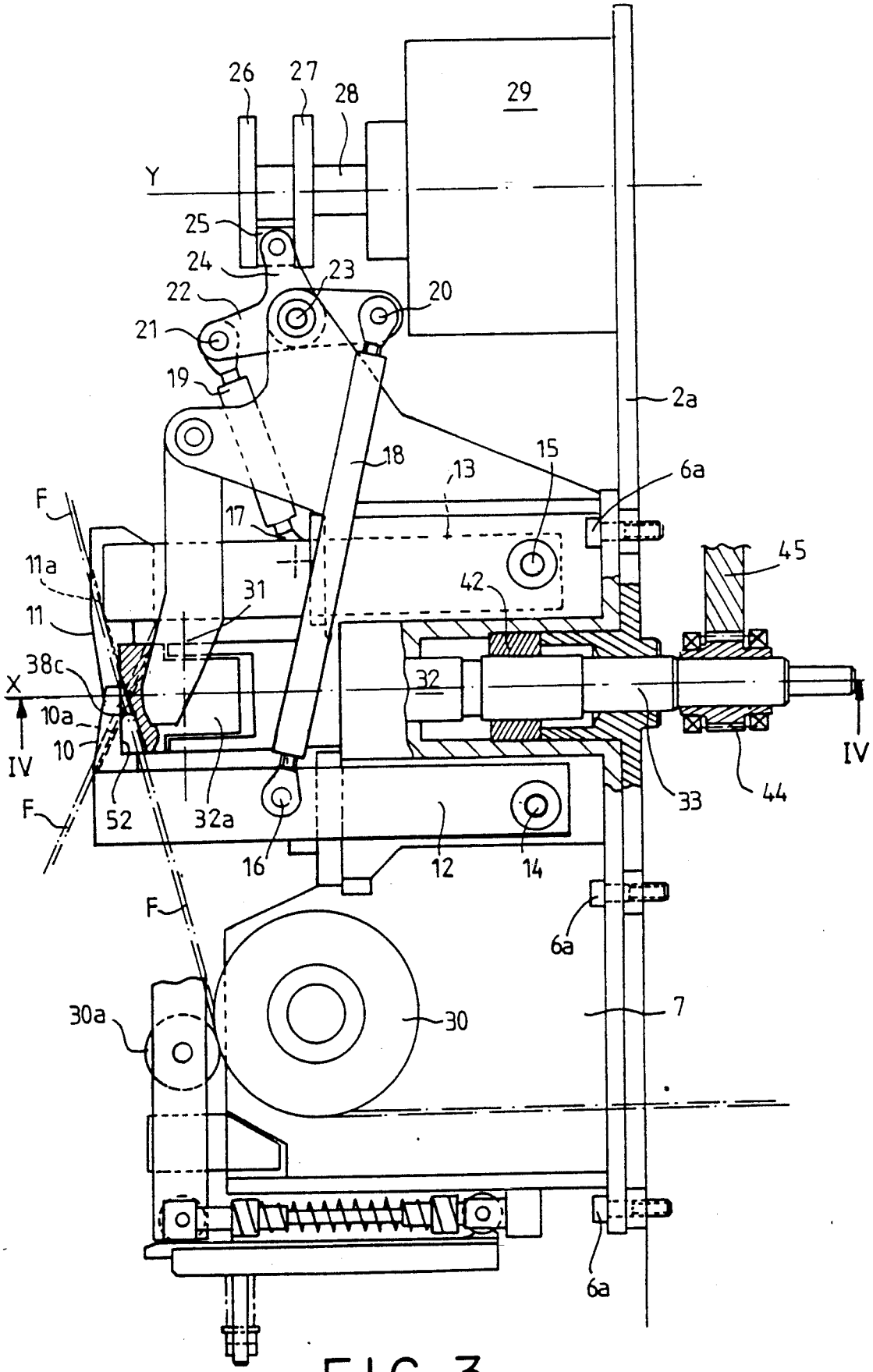
FIG. 3 is a side view, in partial cross section, of a binding device according to the invention incorporated into the compacting and binding apparatus of FIG. 1 and 2.

From FIG. 3, it can further be seen that jaws 37,38 have a rectangular shape so as to be housed, with minimum clearance, in a cut out portion 52 of matching shape provided in the rear face of the thread guide beaks 10,11. FIGS. 3,4 and 8 also show that, on their front faces and along their free edges 37*b*,38*b*, jaws 37,38 are each provided with an open channel, 37*c* or 38*c*, these two channels sloping to converge on the X axis of the twisting head in order, by reason of their mutual dislocation, which can be seen from FIG. 8, to be positioned respectively in alignment with channels 10*a*,11*a* of thread guide beaks 10,11, when the two jaws 37,38 are in their open position, shown in FIG. 4.

This figure further shows that, in its mid portion, body 33 of twisting head 32 has an externally threaded section 41 which is screwed into a fixed nut 42 integral, via a screw 42*a*, with the wall of bore 36. At its rear end, body 33 carries, via one or more axial splines 43, a pinion 44 (FIG. 3). As can be seen from FIG. 2, as well as from the diagrammatic view of FIG. 5, the four pinions 44 of twisting heads 32 of the four binding devices 6 engage, through intermediate pinions 45, with a common central toothed wheel 46 rotated by a hydraulic motor 47.

In the rotary body 33 of the twisting head, there is further provided the cavity, 48, of a hydraulic jack, whose rod 49, centered on the X axis, ends in a frustoconical head 50 turned towards the interval defined between heels 37*a*,38*a* of the two jaws 37,38.

The operation of binding unit 2 equipped with the above described binding devices 6 will now be explained.

With each of the binding devices 6 in the condition illustrated in FIG. 4, a thin, flexible continuous binding thread F provided from one of the supply reels 8 and drawn by a motor driven pulley 30 mounted on frame 7 with its counter tension roller 30*a* engages in channel 38*c* of jaw 38 of the twisting head, and then in channel 11*a* in alignment with thread guide beak 11 so as to pass, upon emerging therefrom, round a section of the coil following guide grooves, not shown, formed in an opening of anvil 4, along the corresponding arm 9 and along the mandrel 5. The binding thread then returns, arriving at the second thread guide 10, through whose channel 10*a* it passes, after which it runs through aligned channel 37*c* of the second jaw 37, thus crossing over itself. Beyond this point, the free end of the thread is gripped by a clamp 31 actuated by a jack, not shown, which clamp, cooperating with supply reel 8 and its pulley 30, draws binding thread F around the coil. In the following moment, jack 48 is activated and the frustoconical head 50 of its rod 49 engages between heels 37*a*,38*a* of jaws 37,38 to bring together the front gripping beaks of the latter so that they securely retain thread F in the vicinity of the point at which it crosses over itself. Shears, not represented, are then operated to cut thread F on the pulley 30 side, thus forming a flexible bond whose two crossed lengths $F_1$,$F_2$ (FIG. 6) are immobilized in twisting head 32.

Then, after tensioning clamp 31 has been withdrawn and thread guide beaks 10,11 have parted as a result of the effect of the retraction of rod 28 of jack 29, each of the twisting heads 32 is rotated by hydraulic motor 47, via the gearing formed by central toothed wheel 46 and pinions 45 and 44. During this rotation, each twisting head is screwed into its nut 42 and, sliding in the associated pinion 44, is given simultaneously a forward translation movement. This dual movement undergone by twisting head 32 enables it to effect a twist joint T that is as close as possible to coil C for binding (see FIG. 7), which is, in practice, at a distance of approximately 3 cm therefrom. Flexible bond F is thus closely fitted around coil C without any risk of subsequent slippage.

Once twist joint T has been effected, the pressure is relieved in jack 48, frustoconical headed rod 49 is retracted by a return spring 51 internal to this jack so that jaws 37,38 open, the direction of rotation of twisting head 32 is reversed and the head is thus translated rearwards. Filament guide beaks 10,11 are then brought towards each other into work position by jack 29, and a new binding cycle can then commence.

We claim:

1. Binding device comprising, a frame (7) associated with a supporting structure (4) for an article to be bound (C), means on the frame (7) for placing a flexible bond (F) around the the article to be bound (C), the flexible bond (F) including opposed end lengths ($F_1$, $F_2$), the means for placing the flexible bond comprising guide members (10, 11) having opposed front and rear ends, the front ends being configured for bringing the two end lengths ($F_1$, $F_2$) to cross over one another, and a twisting head (32) for twisting the two end lengths ($F_1$, $F_2$), the twisting head being arranged at the rear of said guide members and being formed by a gripper (32*a*) and a rotary body (33), the gripper (32*a*) being mounted on the end of the rotary body (33), the binding device being characterized in that it comprises means (41, 42, 43, 44) for guiding and driving the twisting head (32) in translation as it rotates, comprising a nut (42) integral with the frame (7), a threaded portion (41) being defined on the body (33) of the twisting head (32), and being threadedly engaged with the nut (42) such that rotation of the body (33) generates axial movement of the body (33) relative to both the nut (42) and the frame (7), a coupling member (44) surrounding a portion of the body (33) such that the body (33) is slidingly mounted in the coupling member (44), the coupling member (44) being coupled to a means for ensuring its rotation, the said guide members of the flexible bond further being withdrawable in synchronism with the translation of the twisting head.

2. Binding device according to claim 1, characterized in that the body (33) of the twisting head (32) includes at least one axial spline (43) and that the said coupling member is a toothed pinion (44) retained around the body (33) of the twisting head (32) by a connection with the axial spline (43) and engaging with a toothed driving wheel (46) constituting the said means for ensuring rotation.

3. Binding device according to claim 2, characterized in that the gripper (32*a*) is composed of two jaws (37,38) articulated on the body (33) of the twisting head (32), each extended, beyond their axis of articulation (39,40), by a rear heel (37*a*,38*a*), and is further associated with a jack (48) formed in the body (33) with its rod (49) pointing towards the heels of the jaws and ending in a head (50) of a generally conical shape designed to engage between the latter, the heels of the gripper jaws being further biased towards one another in rest condition.

4. Binding device according to claim 3, characterized in that the said members for guiding the flexible bond are constituted by thread guide beaks (10,11), which pivot, crossing over each other in active position in the translation path of the twisting head and cyclically withdrawable from the latter by swinging means (18,19,22,29).

5. A wire coil compacting and binding apparatus comprising several binding subassemblies arranged in a circle on a common support (2*a*), characterized in that the binding subassemblies each are constituted by a binding device (6) according to claim 2.

6. An apparatus according to claim 5, characterized in that the twisting heads (32) of the binding devices (6) are oriented in the same direction with their axes (X) substantially parallel to the central axis (Y) of the article to be bound (C) and their coupling pinions (44) engage with a common driving gear wheel (46).

* * * * *